US010276972B1

(12) United States Patent
Lai et al.

(10) Patent No.: US 10,276,972 B1
(45) Date of Patent: Apr. 30, 2019

(54) POWER CONNECTOR

(71) Applicants: Austin Lai, Taichung (TW); Chi-I Lai, Taichung (TW); Chung Jen Chang, Taichung (TW)

(72) Inventors: Austin Lai, Taichung (TW); Chi-I Lai, Taichung (TW); Chung Jen Chang, Taichung (TW)

(73) Assignee: Avertronics, Inc., Taichung (TW)

( * ) Notice: Subject to any disclaimer, the term of this patent is extended or adjusted under 35 U.S.C. 154(b) by 0 days.

(21) Appl. No.: 16/103,908

(22) Filed: Aug. 14, 2018

(51) Int. Cl.
*H01R 13/52* (2006.01)
*H01R 13/11* (2006.01)

(52) U.S. Cl.
CPC ..... *H01R 13/5219* (2013.01); *H01R 13/113* (2013.01); *H01R 13/521* (2013.01)

(58) Field of Classification Search
CPC ..... H01R 13/5216
USPC ..... 439/587, 589, 935
See application file for complete search history.

(56) References Cited

U.S. PATENT DOCUMENTS 6,142,825 A * 11/2000 Shinchi ..... H01R 13/5216 439/587
6,461,178 B1 * 10/2002 Fu ..... H01R 31/06 439/224
7,422,451 B2 * 9/2008 Chen ..... H01R 13/652 439/101
8,348,688 B2 * 1/2013 Liu ..... H01R 13/5219 439/271
8,388,380 B1 * 3/2013 Van der Steen ... H01R 13/5202 439/607.36
8,827,742 B2 * 9/2014 Wang ..... H01R 24/68 439/569
9,112,299 B2 * 8/2015 Lu ..... H01R 13/5227
9,130,301 B2 * 9/2015 Lu ..... H01R 13/521
9,331,421 B2 * 5/2016 Lai ..... H01R 13/5202
9,350,110 B1 * 5/2016 Ma ..... H01R 13/521
9,385,484 B2 * 7/2016 Chen ..... H01R 13/6594
9,553,410 B2 * 1/2017 Zhao ..... H01R 13/6581
9,564,705 B2 * 2/2017 Arai ..... H01R 13/405
9,640,899 B2 * 5/2017 Kim ..... H01R 13/521
9,711,897 B2 * 7/2017 Ho ..... H01R 13/631
9,711,910 B2 * 7/2017 Zhao ..... H01R 13/6581
9,761,988 B1 * 9/2017 Lin ..... H01R 13/5216
9,812,809 B2 * 11/2017 Arai ..... H01R 13/5202
9,812,810 B2 * 11/2017 Arai ..... H01R 13/41
9,843,128 B2 * 12/2017 Tsai ..... H01R 13/5202
(Continued)

*Primary Examiner* — Neil Abrams
(74) *Attorney, Agent, or Firm* — Che-Yang Chen; Law Offices of Scott Warmuth

(57) ABSTRACT

A power connector may comprise a first connecting member and a second connecting member. The first connecting member has a plurality of first terminals, and a connecting base formed at an end of the second connecting member comprises a plurality of L-shaped slots thereon, and each of the L-shaped slots has a second terminal secured therein. When the first terminals and the second terminals are connected, the first connecting member and the second connecting member are electrically connected. The other end of the second connecting member has a first base which comprises a connecting surface and an assembling surface, and a second frame protruding from the assembling surface has a first housing therein. A cover is disposed in the first housing, and an outer periphery of the cover has a first packing groove filled with a hot-melt adhesive layer to achieve sealing effect.

10 Claims, 11 Drawing Sheets

(56) References Cited

U.S. PATENT DOCUMENTS

| | | | | |
|---|---|---|---|---|
| 9,871,317 | B2 * | 1/2018 | Zhang | H01R 13/5216 |
| 9,871,318 | B2 * | 1/2018 | Wang | H01R 13/5202 |
| 9,935,393 | B2 * | 4/2018 | Tada | H01R 12/724 |
| 9,954,303 | B2 * | 4/2018 | Guo | H01R 12/722 |
| 9,991,625 | B2 * | 6/2018 | Ozaki | H01R 13/5219 |
| 9,997,859 | B2 * | 6/2018 | Yu | H01R 4/2454 |
| 10,027,052 | B2 * | 7/2018 | Yudate | H01R 13/5202 |
| 10,074,930 | B2 * | 9/2018 | Zhu | H01R 13/5202 |
| 10,096,948 | B2 * | 10/2018 | Yu | H01R 13/6581 |
| 2018/0337488 | A1 * | 11/2018 | Zhang | H01R 13/5202 |

* cited by examiner

POWER CONNECTOR

FIELD OF THE INVENTION

The present invention relates to a power connector and more particularly to a blade-typed power connector.

BACKGROUND OF THE INVENTION

Generally, it is common that an electronic device connects to a power supply or other circuits through a wire having a male connector and a female connector at two ends thereof, and through quick connection of the male and female connectors, the electronic device can be electrically connected to a power supply. Nevertheless, the connector is a part which has whole circuit and is relatively prone to get breakdown due to humidity. Also, many electronic devices are used in outdoor or the environment which is humid or where temperature varies greatly, or even in the electronic equipment in motion, and the power connector used for these kinds of electronic devices have a high requirement for waterproof function and electrical connection stability. Thus, a waterproof power connector has been developed, which usually comprises a gasket installed at the connection between a shell and an outer cover of the power connector, thereby achieving the waterproof effect, wherein the gasket is put in an interior of the connector first and the outer cover is locked on the shell of the connector so as to tightly clamp the gasket between the outer cover and the shell.

However, the conventional power connector is disadvantageous because: the pressures caused by force point and non-force point are usually different when the outer cover is locked, which results that gasket is not evenly clamped between the outer cover and the shell, thereby reducing the effect of waterproof; and (ii) the gasket may lose its waterproof function due to elastic fatigue or shrinkage after a long period of use; and (iii) it is too many steps for assembly that may lead to misaligned parts, thereby increasing the defect rate and reducing the effect of waterproof. Therefore, there remains a need for a new and improved design for a power connector to overcome the problems presented above.

SUMMARY OF THE INVENTION

The present invention provides a power connector which comprises a first connecting member and a second connecting member. The first connecting member has a plurality of first terminals, and a connecting base formed at an end of the second connecting member comprises a plurality of L-shaped slots thereon, and each of the L-shaped slots has a second terminal secured therein. Thus, when the first terminals and the second terminals are connected, the first connecting member and the second connecting member are electrically connected. Furthermore, the other end of the second connecting member has a first base, and the first base comprises a connecting surface which is faced to the connecting base and an assembling surface which is located at an opposed side of the connecting surface. In addition, a second frame protruding from the assembling surface has a first housing therein which is communicated with the L-shaped slots, and each of two lateral edges of the second frame comprises an engaging slot at corresponding positions. Each of the second terminals has a pin protruding toward the first housing, and the pin is configured to couple with the second frame and protrude from the first base. The second connecting member has a cover disposed in the first housing, and each of two ends of the cover comprises an engaging block which is adapted to engage with the engaging slot so as to enable the pin to be clamped between the second frame and the cover. Furthermore, an outer periphery of the cover has a first packing groove, and a hot-melt adhesive layer is configured to pave on the first packing groove to achieve sealing effect around the first packing groove, and the hot-melt adhesive layer is adapted to seal around the pin.

In one embodiment, a second packing groove is formed on an inner periphery of the second frame of the second connecting member, and the second packing groove is adapted to collaborate with the first packing groove to circle around the pin, and the hot-melt adhesive layer is adapted to be filled around the pin with the thickness same as the depth of the first packing groove and the second packing groove.

In another embodiment, the second connecting member has a plurality of locating slots, and each of the locating slots is located between two adjacent pins, and a plurality of abutting blocks are formed at an edge of the cover; the first packing groove is formed across an peripheral edge of the abutting blocks, and the abutting blocks are accommodated in the locating slots so as to secured the single pin between two adjacent abutting blocks, and the pins are configured to protrude from a surface of the cover paved with the hot-melt adhesive layer.

In still another embodiment, the connecting base has a plurality of partitions, and each of the partitions is located between two adjacent L-shaped slots, and a bottom portion is extended from the partition to accommodate in the first housing; a concaved second housing is formed on the other surface of the cover which is faced to the first housing, and the second housing is extended to the abutting blocks; a waterproof second gasket is installed at the second housing, and the second gasket is directly abutted against the bottom portions of the partitions, and the second gasket is configured to surround outer peripheries of the pins.

In a further embodiment, the first base has two block bodies protruding from the assembling surface, and the two block bodies are connected to the second frame to reinforce the structural strength of the second frame; the second frame is processed to form the two engaging slots without penetrating through the second frame.

In still a further embodiment, the first base comprises two inner threaded bushings, and each of the inner threaded bushings has an end extending to the connecting surface of the first base, and the other end of the inner threaded bushing is configured to extend to an interior of the block body so as to enable the block body to enhance the structural strengths between the first base and the inner threaded bushing.

In yet a further embodiment, a sealing unit connected to the first connecting member comprises a plurality of through holes which are configured to be respectively passed through by the first terminals; a side piece vertical protrudes from an edge of the sealing unit to form an L-shape, and the sealing unit collaborated with the side piece is abutted against the L-shaped slot when the first terminal is connected to the second terminal.

In a particular embodiment, the second connecting member has a first gasket disposed on the connecting base, and the first gasket abutted against the connecting surface is configured to achieve the waterproof effect when the first base of the second connecting member is connected to an external component, and the first gasket is abutted against between the first base and the external component.

In another particular embodiment, an annular groove is formed on the connecting surface of the first base, and a third frame is connected to an inner edge of the first gasket; the third frame is wider than the first gasket so as to axially protrude from two lateral sides of the first gasket to form a first protruding portion and a second protruding portion, wherein the first protruding portion faced to the second connecting member is configured to insert into the annular groove, and a second protruding portion protrudes toward the first connecting member, and the second protruding portion is abutted when the second connecting member is connected to an external part so as to enable the first protruding portion to abut against the annular groove.

In still another particular embodiment, each of the second terminals has a first frame which enables the second terminal to be secured in the L-shaped slot, and two parallel clamping pieces are configured to extend from the first frame toward the second frame, and each of the clamping pieces has a offset bending thereon; an end of the clamping piece connected to the first frame is located close to an opening of the L-shaped slot, and the other end of the clamping piece is located close to the first housing so as to enable the two clamping pieces to tightly clamp a lower portion of the first terminal.

Comparing with conventional power connector, the present invention is advantageous because: (i) the cover is disposed in the first housing, and the engaging blocks are respectively engaged with the engaging slots such that the cover is filled with the first housing, and the engagement between the engaging block and the engaging slot is configured to secure the relative position of the second frame and the cover so as to enforce the structural strength of the assembly; (ii) the hot-melt adhesive layer is configured to fill along a way between the second frame and the cover so as to fill with the first packing groove and the second packing groove, and the gap between the second frame and the cover; (iii) the processed engaging slots is formed irrelative to the thickness of the second frame such that positions of the engaging slots which not penetrate through the second frame have no need to have additional sealing process to achieve the waterproof effect; and (iv) each of the inner threaded bushings is formed on the block body so as to improve the connection between the inner threaded bushing and the first base and increase the length of the inner threaded bushing.

DETAILED DESCRIPTION OF THE INVENTION

Figure 1:
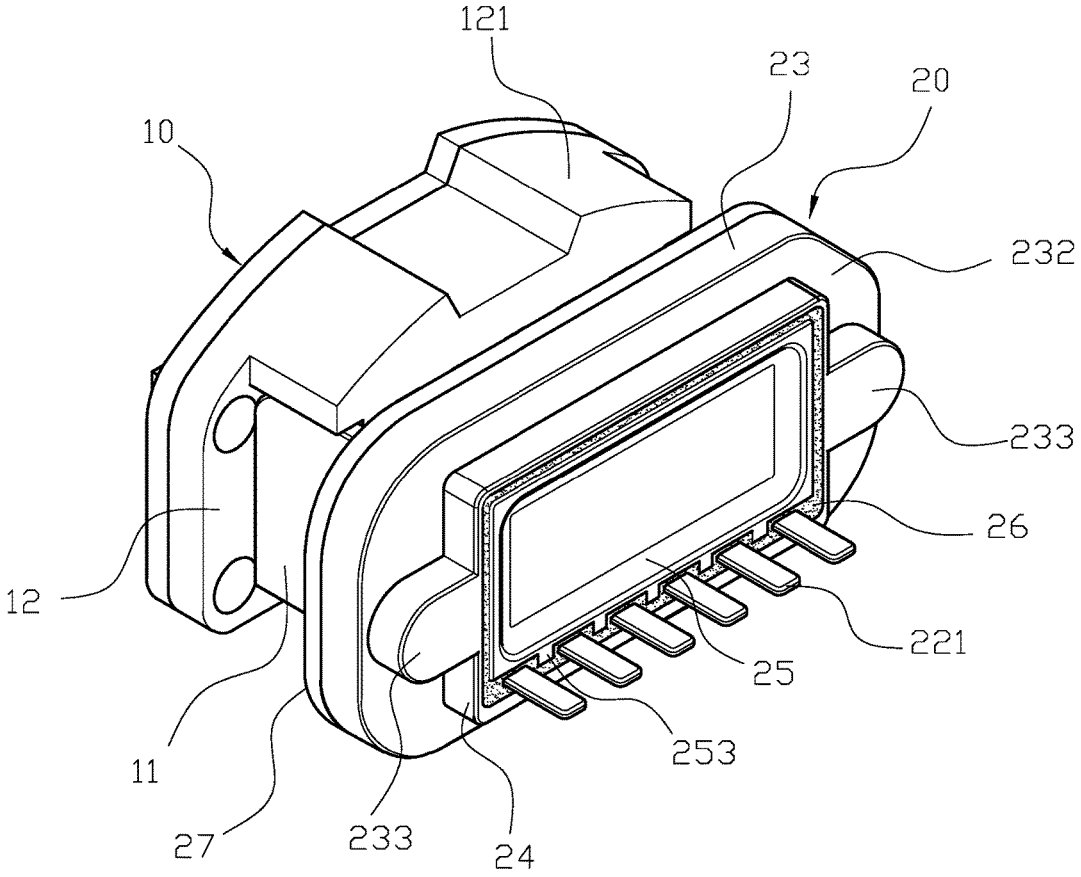
FIG. 1 is a three-dimensional assembly view of a power connector of the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, the present invention provides a power connector which comprises a first connecting member (10) and a second connecting member (20). The first connecting member (10) has a plurality of first terminals (11), and a sealing unit (12) connected to the first connecting member (10) comprises a plurality of through holes (121) which are configured to be respectively passed through by the first terminals (11). Moreover, a side piece (122) vertical protrudes from an edge of the sealing unit (12) to form an L-shape. A connecting base (21) formed at an end of the second connecting member (20) comprises a plurality of L-shaped slots (211) thereon, and each of the L-shaped slots (211) has a second terminal (22) secured therein. Thus, when the first terminals (11) and the second terminals (22) are connected, the first connecting member (10) and the second connecting member (20) are electrically connected, and the sealing unit (12) collaborated with the side piece (122) is abutted against the L-shaped slot (211). Furthermore, the other end of the second connecting member (20) has a first base (23), and the first base (23) comprises a connecting surface (231) which is faced to the connecting base (21) and an assembling surface (232) which is located at an opposed side of the connecting surface (231). In addition, a second frame (24) protruding from the assembling surface (232) has a first housing (241) therein which is communicated with the L-shaped slots (211), and each of two lateral edges of the second frame (24) comprises an engaging slot (242) at corresponding positions. Also, the first base (23) has two block bodies (233) protruding from the assembling surface (232), and the two block bodies (233) are connected to the second frame (24) to reinforce the structural strength of the second frame (24). Moreover, the second frame (24) is processed to form the two engaging slots (242) without penetrating through the second frame (24), thereby enhancing the waterproof effect at positions of the engaging slots (242). Additionally, the first base (23) comprises two inner threaded bushings (234), and each of the inner threaded bushings (234) has an end extending to the connecting surface (231) of the first base (23), and the other end of the inner threaded bushing (234) is configured to extend to an interior of the block body (233) so as to enable the block body (233) to enhance the structural strengths between the first base (23) and the inner threaded bushing (234). Each of the second terminals (22) has a pin (221) protruding toward the first housing (241), and the pin (221) is configured to couple with the second frame (24) and protrude from the first base (23). The second connecting member (20) has a cover (25) disposed in the first housing (241), and each of two ends of the cover (25) comprises an engaging block (251) which is configured to engage with the engaging slot (242) so as to enable the pin (221) to be clamped between the second frame (24) and the cover (25). Furthermore, an outer periphery of the cover (25) has a first packing groove (252), and a hot-melt adhesive layer (26) is configured to pave on the first packing groove (252) to achieve sealing effect on the first packing groove (252), and the hot-melt adhesive layer (26) is configured to seal around the pin (221). A second packing groove (243) is formed on an inner periphery of the second frame (24) of the second connecting member (20), and the second packing groove (243) is adapted to collaborate with the first packing groove (252) to circle around the pin (221), and the hot-melt adhesive layer (26) is adapted to be filled around the pin (221) with the thickness same as the depth of the first packing groove (252) and the second packing groove (243). Each of the second terminals (22) has a first frame (222) which enables the second terminal (22) to be secured in the L-shaped slot (211), and two parallel clamping pieces (223) are configured to extend from the first frame (222) toward the second frame (24), and each of the clamping pieces (223) has a offset bending thereon. Also, an end of the clamping piece (223) connected to the first frame (222) is located close to an opening of the L-shaped slot (211), and the other end of the clamping piece (223) is located close to the first housing (241) so as to enable the two clamping pieces (223) to tightly clamp a lower portion of the first terminal (11), thereby strengthening the connection when the first terminal (11) and the second terminal (22) are connected.

Structurally, referring to FIGS. 2 to 7, the second terminals (22) are installed in the second connecting member (20) through the first housing (241), and the second terminals (22) respectively are secured in the L-shaped slots (211) through the first frames (222), and the pin (221) of the second terminal (22) is extending out of the second frame (24). Thereafter, the cover (25) is disposed in the first housing (241), and the engaging blocks (251) are respectively engaged with the engaging slots (242) such that the cover (25) is filled with the first housing (241). Furthermore, the engagement between the engaging block (251) and the engaging slot (242) is configured to secure the relative position of the second frame (24) and the cover (25) so as to enforce the structural strength of the assembly. Moreover, the hot-melt adhesive layer (26) is configured to fill along a way between the second frame (24) and the cover (25) so as to fill with the first packing groove (252) and the second packing groove (243), and the gap between the second frame (24) and the cover (25). Additionally, the first packing groove (252) and the second packing groove (243) are adapted to circle around the pin (221) such that the pouring hot-melt adhesive layer (26) is configured to directly flow in the first packing groove (252) and the second packing groove (243) and fill around the pin (211) to the thickness same as the depth of the first packing groove (252) and the second packing groove (243). Since the hot-melt adhesive layer (26) is only used to seal a single surface, the processing step of the power connector is simplified so as to achieve the practical functions of easy filling and effective waterproof. Also, the block bodies (233) of the first base (23) are connected to the second frame (24) so as to enhance the structural strength of the power connector. Meanwhile, the processed engaging slots (242) is formed irrelative to the thickness of the second frame (24) such that positions of the engaging slots (242) which not penetrate through the second frame (24) have no need to have additional sealing process to achieve the waterproof effect. Moreover, each of the inner threaded bushings (234) is formed on the block body (233) so as to improve the connection between the inner threaded bushing (234) and the first base (23) and increase the length of the inner threaded bushing (234). In one embodiment, the inner threaded bushing (234) is made of metal. Through the inner threaded bushings collaborating with the block bodies (233), the second connecting member (20) is configured to securely engage with an external component. To sum up, the block bodies (233) can be used for the engaging slots (242) and the inner threaded bushings (234). Additionally, the second connecting member (20) has a first gasket (27) disposed on the connecting base (21), and the first gasket (27) abutted against the connecting surface (231) is configured to achieve the waterproof effect when the first base (23) of the second connecting member (20) is connected to an external component, wherein the first gasket (27) is abutted against between the first base (23) and the external component. Also, an annular groove (235) is formed on the connecting surface (231) of the first base (23), and a third frame is connected to an inner edge of the first gasket (27). The third frame is wider than the first gasket (27) so as to axially protrude from two lateral sides of the first gasket (27) to form a first protruding portion (271) and a second protruding portion (272), wherein the first protruding portion (271) faced to the second connecting member (20) is configured to insert into the annular groove (235), and a second protruding portion (272) protrudes toward the first connecting member (10).

Figure 8:
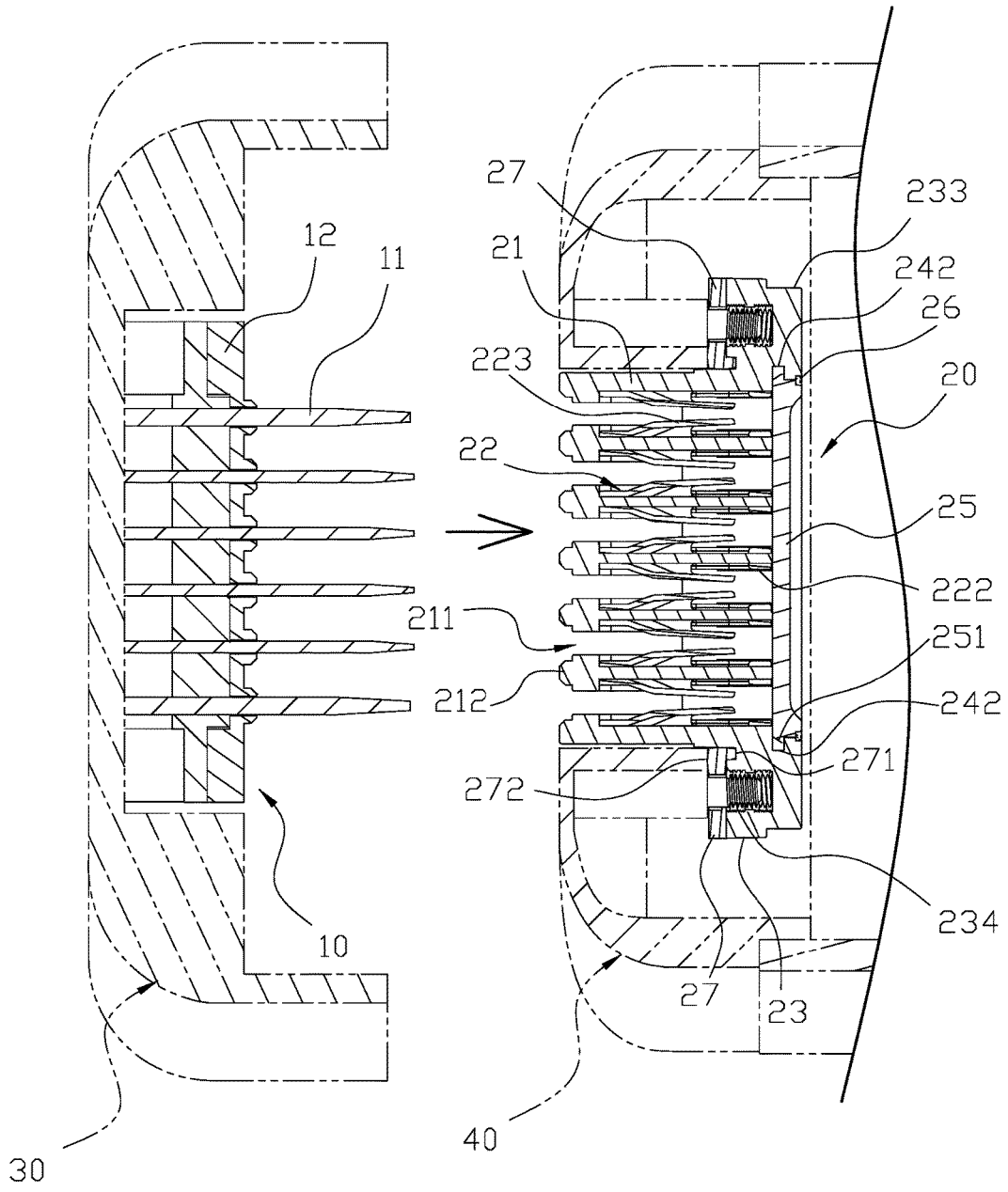
FIG. 8 is a schematic view illustrating the power connector of the present invention is in use.
Figure 9:
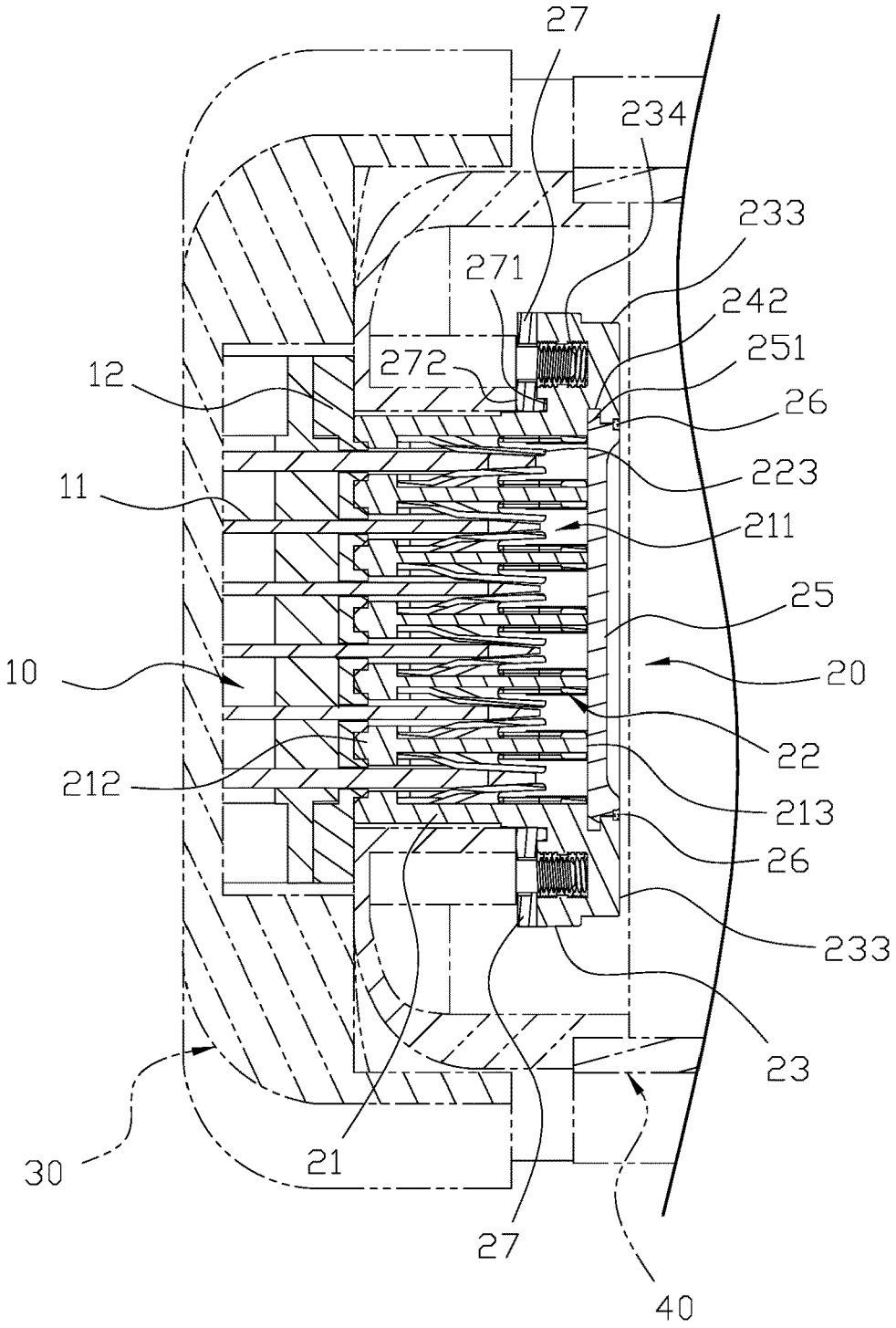
FIG. 9 is another schematic view illustrating the power connector of the present invention is in use.

In actual application, referring to FIGS. 8 and 9, the first connecting member (10) is locked on a first component (30), and the first terminals (11) and the side piece (122) respectively protrude from an end of the first component (30). Also, the second connecting member (20) is locked on a second component (40) through the inner threaded bushings (234) from inside to outside so as to expose the connecting base (21) from an end of the second component (40). Moreover, the second protruding portion (272) is abutted when the second connecting member (20) is connected to the second component (40) so as to enable the first protruding portion (271) to abut against the annular groove (235), thereby improving the waterproof effect between the second connecting member (20) and the second component (40). Furthermore, the first terminals (11) of the first connecting member (10) are inserted into the L-shaped slots (211) of the second connecting member (20), and the clamping pieces (223) are configured to clamp the first terminals (11) so as to electrically connect the first connecting member (10) to the second connecting member (20). In addition, the sealing unit (12) is collaborated with the side piece (122) to abut against the L-shaped slots (211) so as to achieve the waterproof effect of the connection between the first component (30) and the second component (40). Also, the fixed end of the clamping piece (223) connected to the first frame (222) is located adjacent to the opening of the L-shaped slot (211), which enables two adjacent clamping pieces (223) to have maximum clamping force such that the second terminals (22) are configured to tightly clamp the lower portions of the first terminals (11). Thus, the first terminals (11) and the second terminals (22) are firmly connected.

Figure 2:
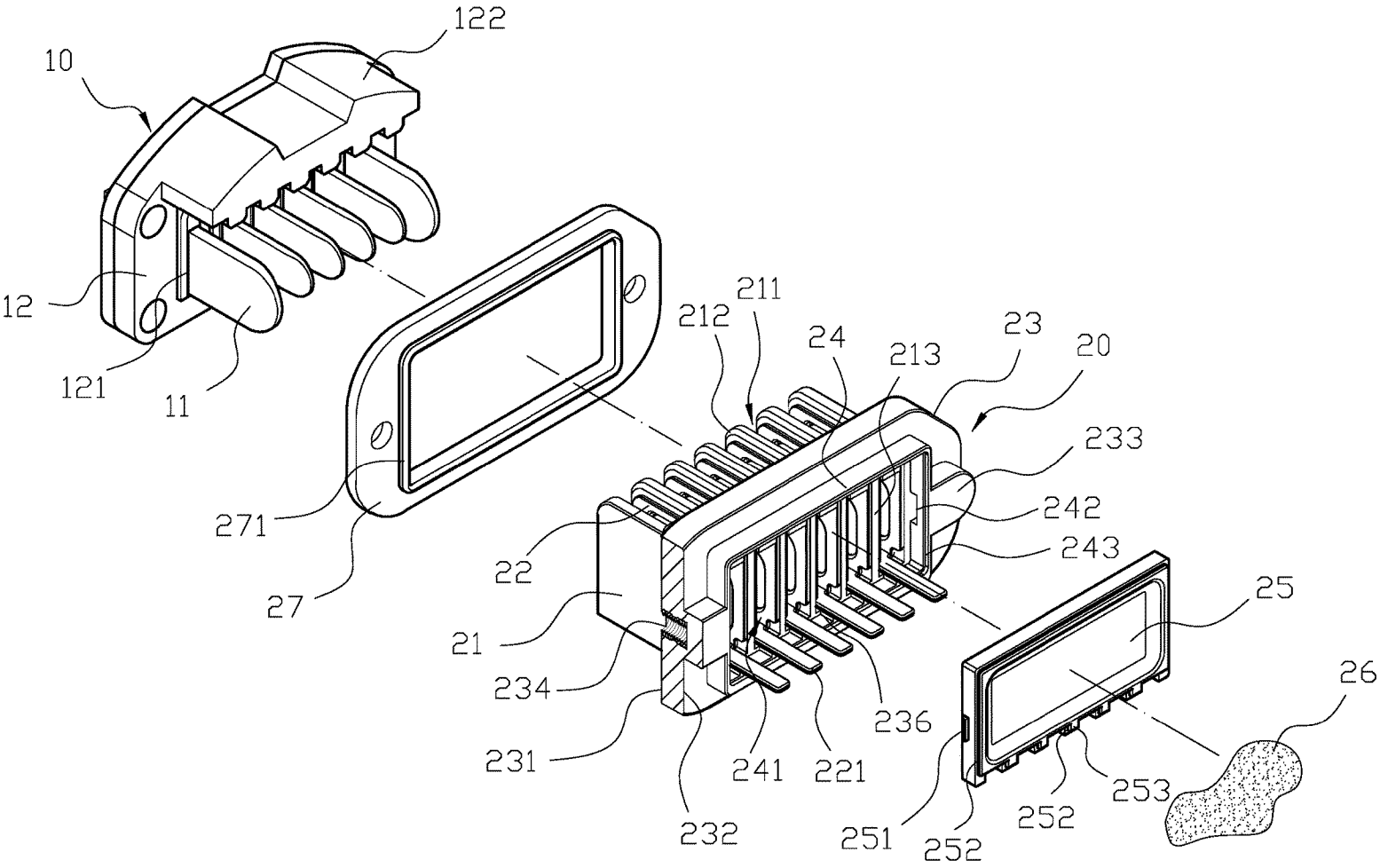
FIG. 2 is another three-dimensional assembly view of the power connector of the present invention.
Figure 3:
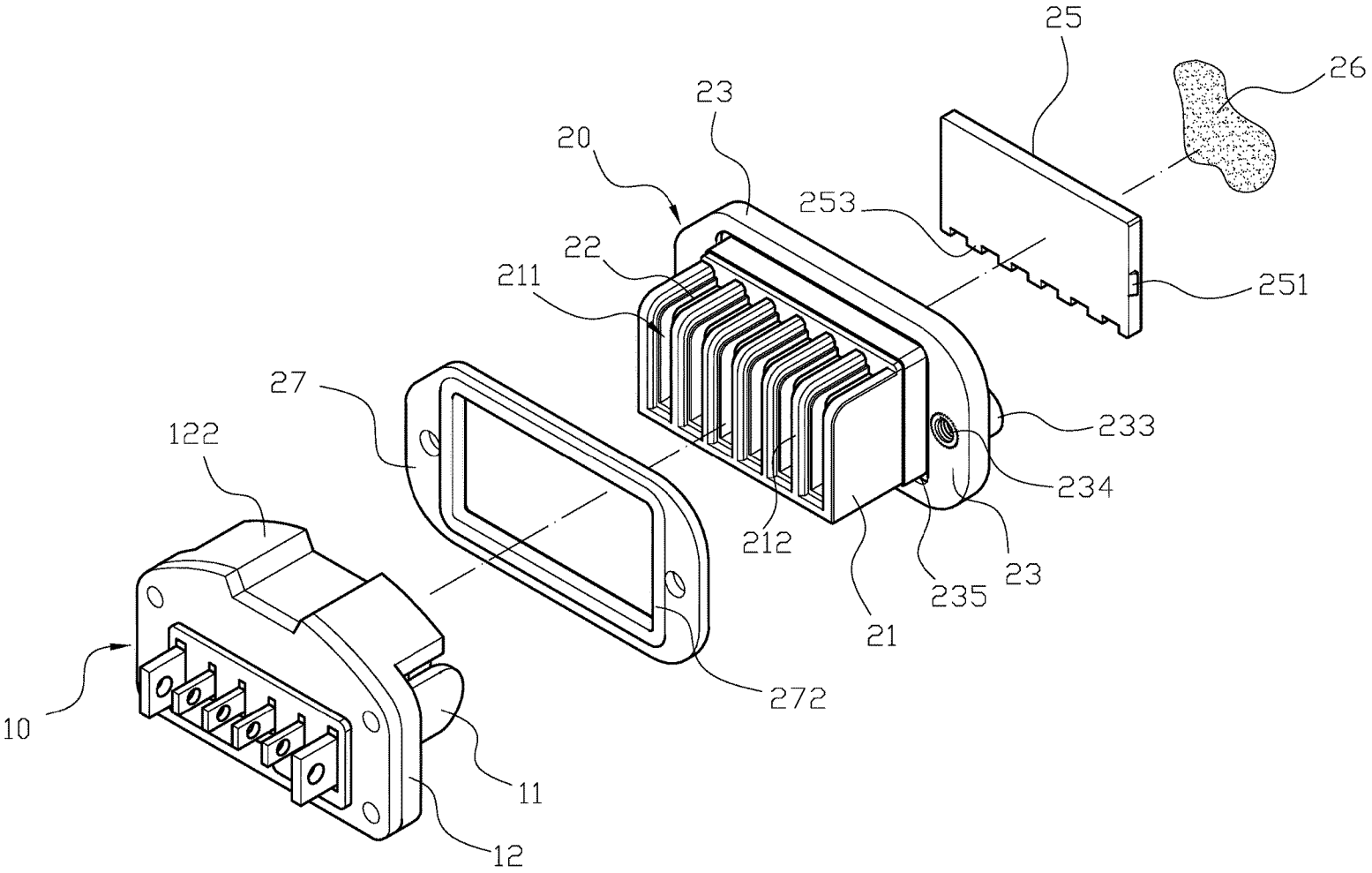
FIG. 3 is a third three-dimensional assembly view of the power connector of the present invention.
Figure 4:
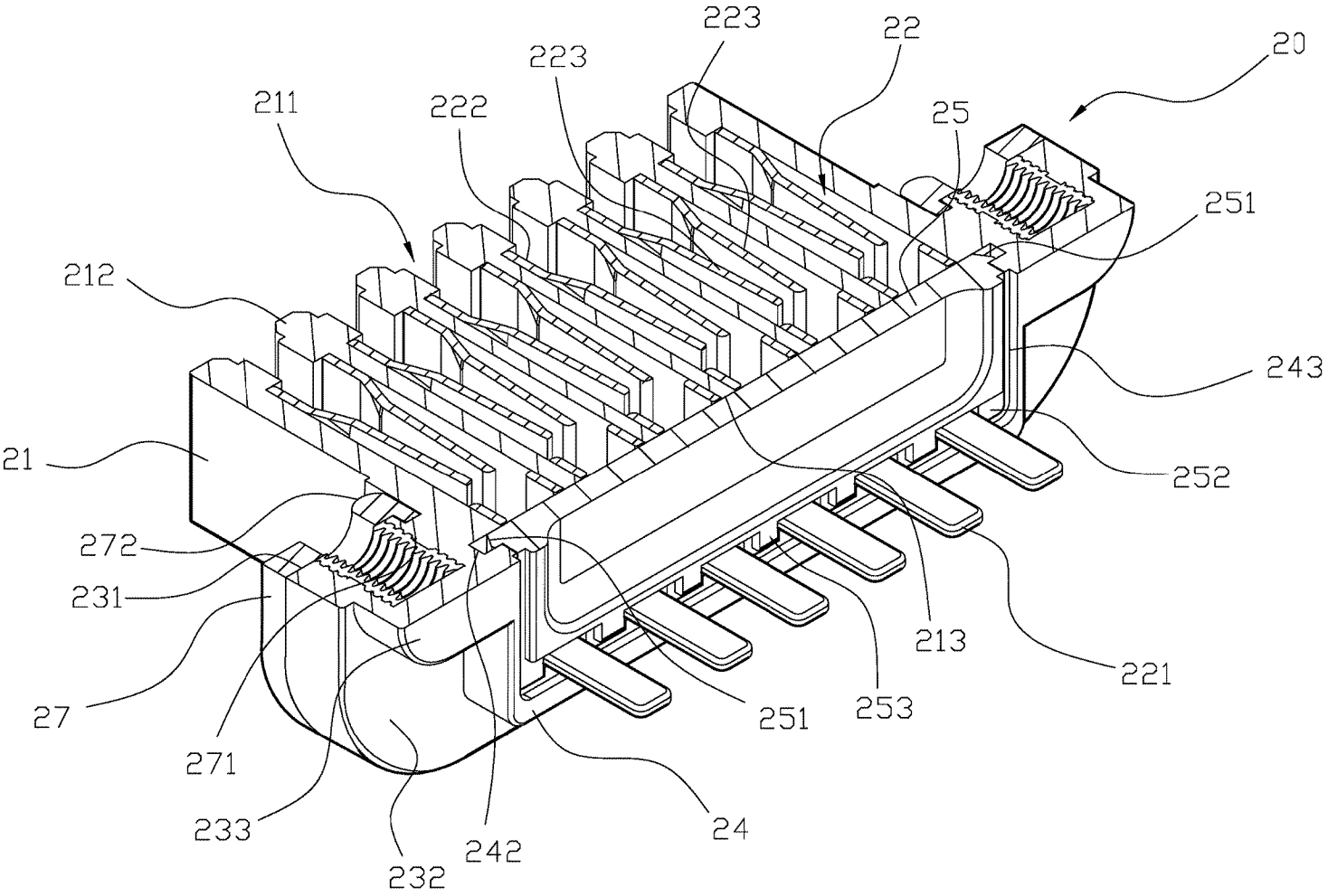
FIG. 4 is a three-dimensional exploded view of a second connecting member of the power connector of the present invention.
Figure 5:
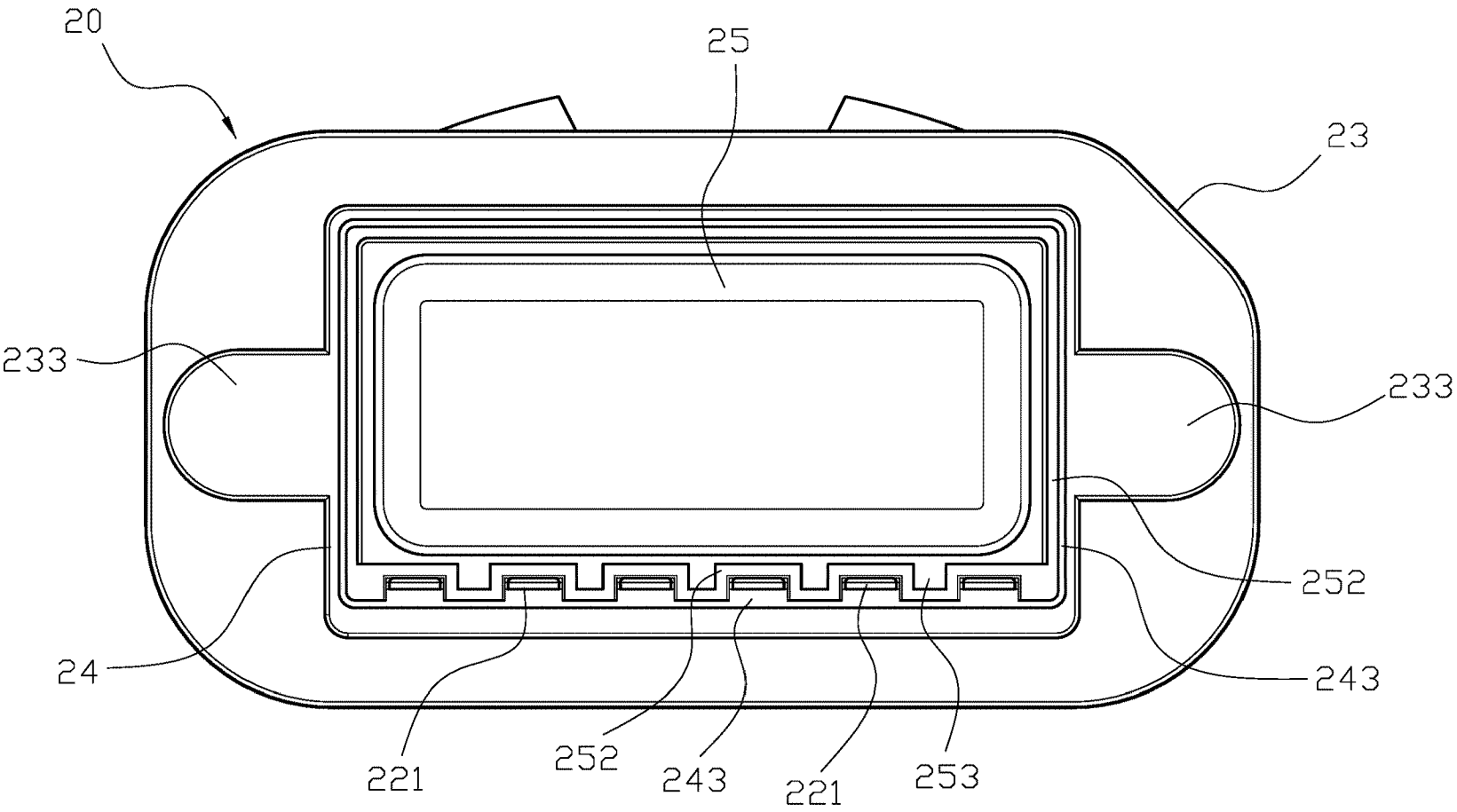
FIG. 5 is a schematic view of the power connector of the present invention before a hot-melt adhesive layer is applied.
Figure 6:
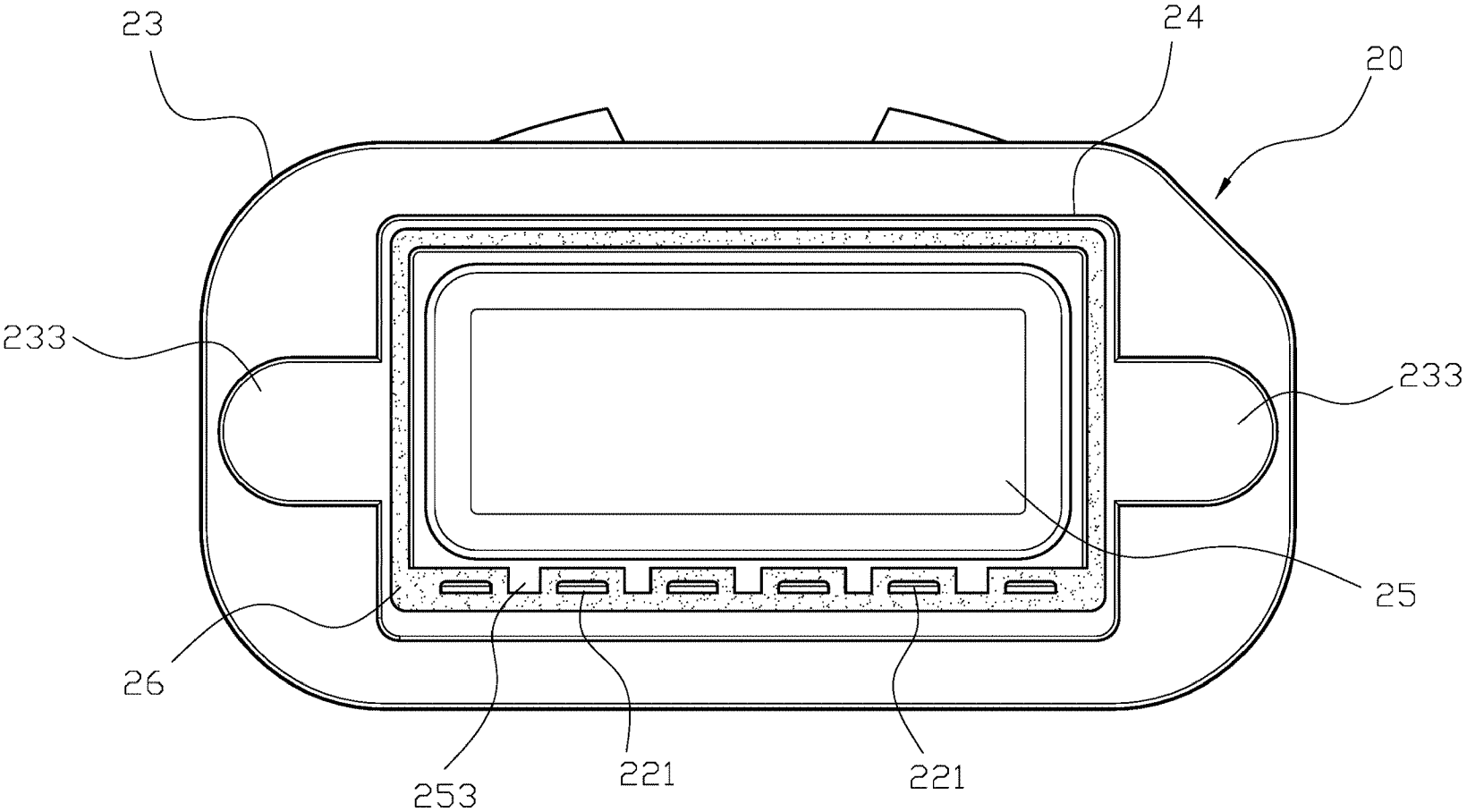
FIG. 6 is a schematic view of the power connector of the present invention after the hot-melt adhesive layer is applied.
Figure 7:
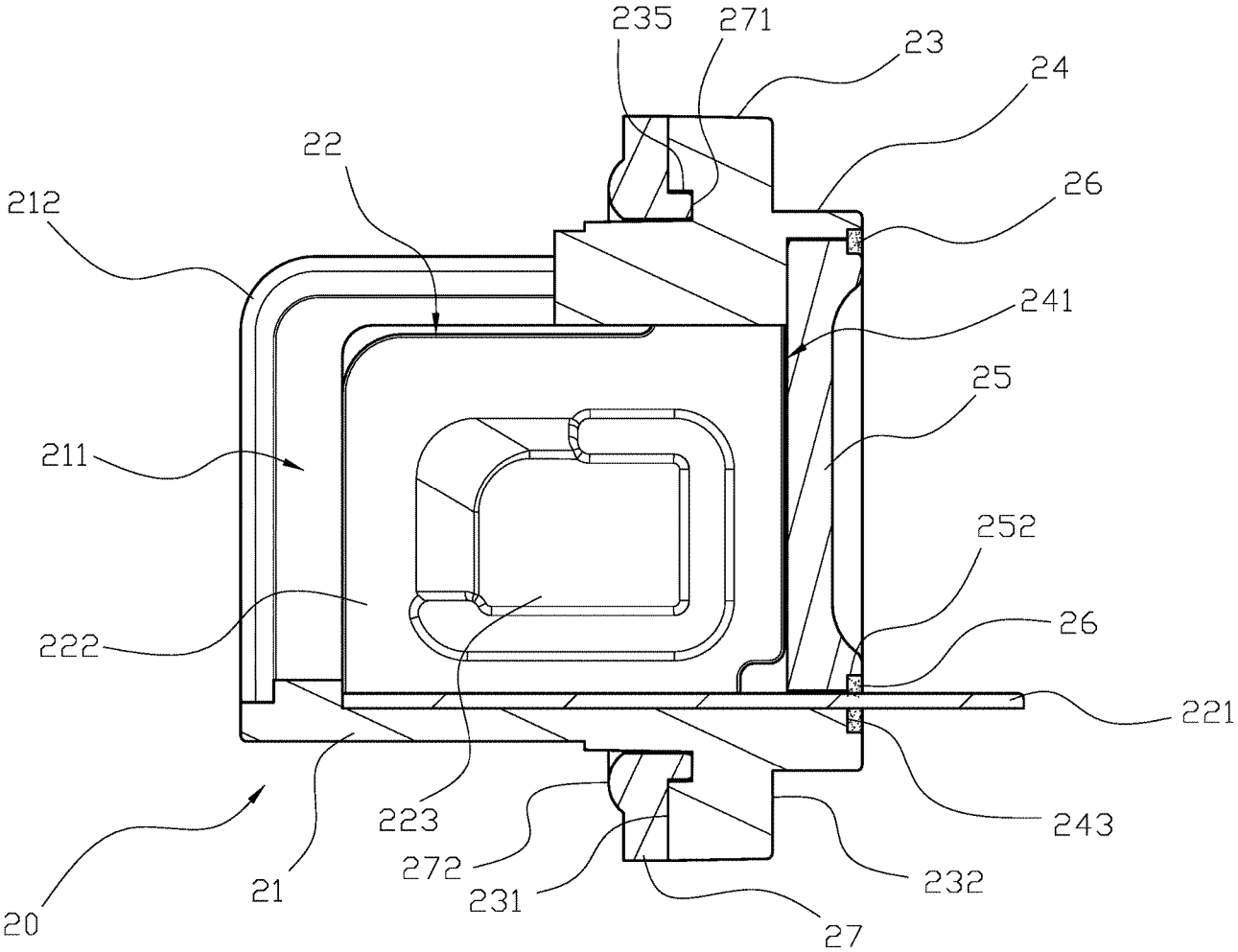
FIG. 7 is a sectional view of the power connector of the present invention after the hot-melt adhesive layer is applied.
Figure 10:
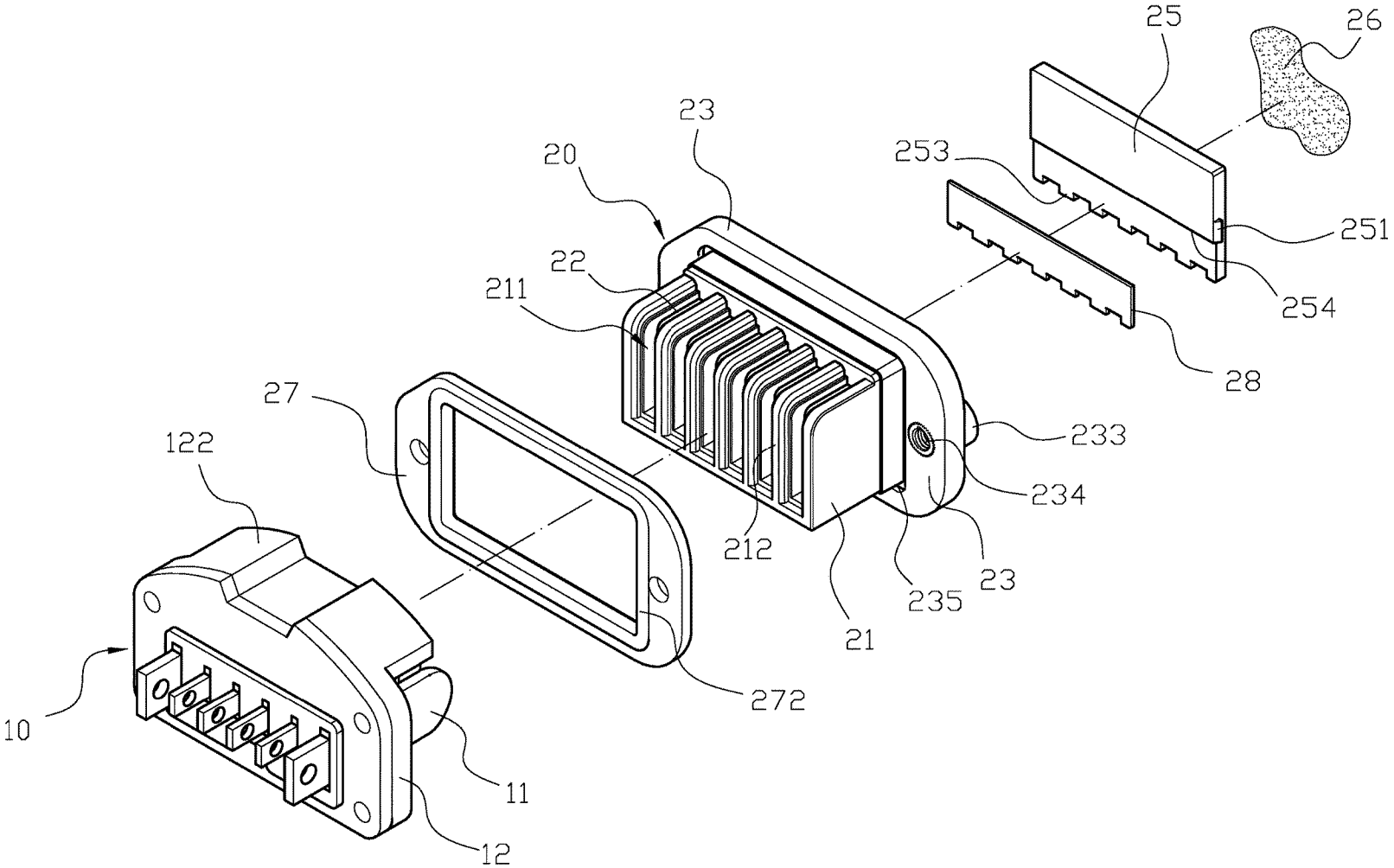
FIG. 10 is a three-dimensional exploded view of another embodiment of the power connector of the present invention.
Figure 11:
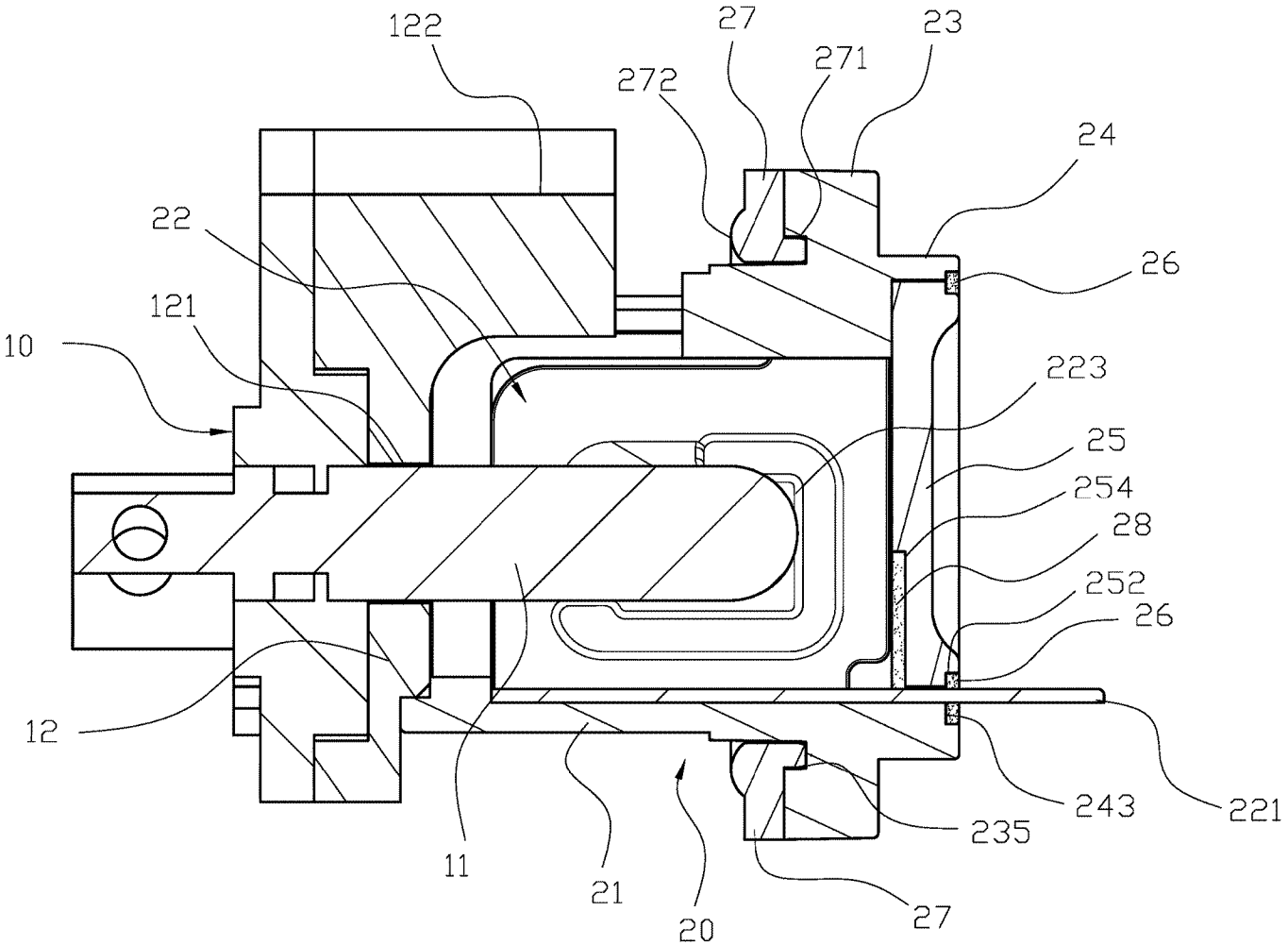
FIG. 11 is a sectional view of another embodiment of the power connector of the present invention.

In another embodiment, referring to FIGS. 2, 10 and 11, the second connecting member (20) has a plurality of locating slots (236), and each of the locating slots (236) is located between two adjacent pins (221), and a plurality of abutting blocks (253) are formed at an edge of the cover (25). The first packing groove (252) is formed across an peripheral edge of the abutting blocks (253), and the abutting blocks (253) are accommodated in the locating slots (236) so as to secured the single pin (221) between two adjacent abutting blocks (253), and the pins (221) are configured to protrude from a surface of the cover (25) paved with the hot-melt adhesive layer (26), thereby achieving the effects of easy assembly and waterproof. Furthermore, the connecting base (21) has a plurality of partitions (212), and each of the partitions is located between two adjacent L-shaped slots (211). Also, a bottom portion (213) is extended from the partition (212) to accommodate in the first housing (241). A concaved second housing (254) is formed on the other surface of the cover (25) which is faced to the first housing (241), and the second housing (254) is extended to the abutting blocks (253). Moreover, a second gasket (28) which is waterproof is installed at the second housing (254), and the second gasket (28) is directly abutted against the bottom portions (213) of the partitions (212), and the second gasket (28) is configured to surround outer peripheries of the pins (221) so as to collaborate with the hot-melt adhesive layer (26) to achieve double waterproof effect.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A power connector comprising, a first connecting member having a plurality of first terminals, and a second connecting member comprising a connecting base at an end thereof, and the connecting base having a plurality of L-shaped slots thereon, and each of the L-shaped slots comprising a second terminal secured therein; when the first terminals and the second terminals connected, the first connecting member and the second connecting member electrically connected; the other end of the second connecting member having a first base, and the first base comprising a connecting surface which is faced to the connecting base and an assembling surface which is located at an opposed side of the connecting surface; a second frame, which protrudes from the assembling surface, comprising a first housing therein which is communicated with the L-shaped slots, and each of two lateral edges of the second frame having an engaging slot at corresponding positions; each of the second terminals comprising a pin protruding toward the first housing, and the pin configured to couple with the second frame and protrude from the first base; the second connecting member having a cover disposed in the first housing, and each of two ends of the cover comprising an engaging block which is adapted to engage with the engaging slot so as to enable the pin to be clamped between the second frame and the cover; an outer periphery of the cover having a first packing groove, and a hot-melt adhesive layer configured to pave on the first packing groove to achieve sealing effect on the first packing groove, and the hot-melt adhesive layer adapted to seal around the pin.

2. The power connector of claim 1, wherein a second packing groove is formed on an inner periphery of the second frame of the second connecting member, and the second packing groove is adapted to collaborate with the first packing groove to circle around the pin, and the hot-melt adhesive layer is adapted to be filled around the pin with the thickness same as the depth of the first packing groove and the second packing groove.

3. The power connector of claim 1, wherein the second connecting member has a plurality of locating slots, and each of the locating slots is located between two adjacent pins; a plurality of abutting blocks are formed at an edge of the cover; the first packing groove is formed across an peripheral edge of the abutting blocks, and the abutting blocks are accommodated in the locating slots so as to secured the single pin between two adjacent abutting blocks, and the pins are configured to protrude from a surface of the cover which is paved with the hot-melt adhesive layer.

4. The power connector of claim 3, wherein the connecting base has a plurality of partitions, and each of the partitions is located between two adjacent L-shaped slots, and a bottom portion is extended from the partition to accommodate in the first housing; a concaved second housing is formed on the other surface of the cover which is faced to the first housing, and the second housing is extended to the abutting blocks; a waterproof second gasket is installed at the second housing, and the second gasket is directly abutted against the bottom portions of the partitions, and the second gasket is configured to surround outer peripheries of the pins.

5. The power connector of claim 1, wherein the first base has two block bodies protruding from the assembling surface, and the two block bodies are connected to the second frame to reinforce the structural strength of the second frame; the second frame is processed to form the two engaging slots without penetrating through the second frame.

6. The power connector of claim 5, wherein the first base comprises two inner threaded bushings, and each of the inner threaded bushings has an end extending to the connecting surface of the first base, and the other end of the inner threaded bushing is configured to extend to an interior of the block body so as to enable the block body to enhance the structural strengths between the first base and the inner threaded bushing.

7. The power connector of claim 1, wherein a sealing unit connected to the first connecting member comprises a plurality of through holes which are configured to be respectively passed through by the first terminals; a side piece vertical protrudes from an edge of the sealing unit to form an L-shape, and the sealing unit collaborated with the side piece is abutted against the L-shaped slot when the first terminal is connected to the second terminal.

8. The power connector of claim 1, wherein the second connecting member has a first gasket disposed on the connecting base, and the first gasket abutted against the connecting surface is configured to achieve the waterproof effect when the first base of the second connecting member is connected to an external component, and the first gasket is abutted against between the first base and the external component.

9. The power connector of claim 8, wherein an annular groove is formed on the connecting surface of the first base, and a third frame is connected to an inner edge of the first gasket; the third frame is wider than the first gasket so as to axially protrude from two lateral sides of the first gasket to form a first protruding portion and a second protruding portion, wherein the first protruding portion faced to the second connecting member is configured to insert into the annular groove, and a second protruding portion protrudes toward the first connecting member, and the second protruding portion is abutted when the second connecting member is connected to an external part so as to enable the first protruding portion to abut against the annular groove.

10. The power connector of claim 1, wherein each of the second terminals has a first frame which enables the second terminal to be secured in the L-shaped slot, and two parallel clamping pieces are configured to extend from the first frame toward the second frame, and each of the clamping pieces has a offset bending thereon; an end of the clamping piece connected to the first frame is located close to an opening of the L-shaped slot, and the other end of the clamping piece is located close to the first housing so as to enable the two clamping pieces to tightly clamp a lower portion of the first terminal.

* * * * *